United States Patent [19]

Baudisch et al.

[11] Patent Number: 4,482,522

[45] Date of Patent: Nov. 13, 1984

[54] REDUCING SOCKET FOR RECEPTACLE CARRIERS OF LABORATORY CENTRIFUGES FOR ACCOMMODATIONS OF TEST TUBES OR TEST VESSELS

[75] Inventors: Hans-Dieter Baudisch, Leipzig; Roland Lippoldt, Engelsdorf, both of German Democratic Rep.

[73] Assignee: VEB Kombinat Medizin- und Labortechnik Leipzig, Leipzig, German Democratic Rep.

[21] Appl. No.: 361,951

[22] Filed: Mar. 25, 1982

[30] Foreign Application Priority Data

Jul. 6, 1981 [DD] German Democratic Rep. ... 231456

[51] Int. Cl.[3] ..... B01L 9/06

[52] U.S. Cl. ..... 422/104; 211/72; 211/74

[58] Field of Search ..... 211/72, 74; 422/104

[56] References Cited

U.S. PATENT DOCUMENTS 3,379,315 4/1968 Broadwin ..... 211/72

*Primary Examiner*—Michael S. Marcus

*Attorney, Agent, or Firm*—Jordan and Hamburg

[57] ABSTRACT

The reducing socket which is constructed as a cage, is essentially formed by six walls, which are joined together in a cube-shaped or parallelepiped-shaped manner. These walls are provided with openings for the insertion of test vessels. The burrholes of the individual walls are of different sizes. These openings on an individual wall may have both equal and different sizes. The supporting plate which is attached either within or outside of the cage, covers the openings of this wall, which is situated opposite to the wall accommodating the test vessels. If the supporting plate lies within the cage and the size of the test vessel is changed, this plate falls by itself to the wall, the openings of which are covered-up. The reducing socket according to the invention enables the use of different test vessel diameters, without requiring a particular expenditure.

2 Claims, 2 Drawing Figures

REDUCING SOCKET FOR RECEPTACLE CARRIERS OF LABORATORY CENTRIFUGES FOR ACCOMMODATIONS OF TEST TUBES OR TEST VESSELS

BACKGROUND OF THE INVENTION AND PRIOR ART STATEMENT

The invention concerns a reducing socket which, when put into a receptacle carrier of laboratory centrifuges, will be complemented by test tubes or vessels which are filled with specimens.

Reducing sockets are known (see leaflets of the firms Hettich, FRG, Beckman, USA and Sorvall, USA) which are adjusted with their outer diameters and with their length to the receptacle carrier of a laboratory centrifuge and which are provided with one or several burr holes in the longitudinal axis of the receptacle carrier for accommodation of test tubes. The disadvantage of these reducing sockets is the fact that, for any tube diameter, a special reducing socket has to be available, which would increase storage expenses and thus would not be economical.

With this invention a reducing socket for receptacle carriers of laboratory centrifuges should be presented, which without the need of performing modifications at the receptacle carrier may be completed with test vessels of different diameters without requiring an additional expenditure in material as would be necessary with reducing sockets known until now.

SUMMARY OF THE INVENTION

The invention was based on the object of developing a reducing socket having a higher function value than the one as described in the conventional technical level without additional expenditure in material.

According to the invention, this problem is solved by cube-shaped or parallelepiped-shaped cage forming walls of which at least two are provided with an opening corresponding to at least one of the test vessels, the openings of the individual walls having different sizes, with openings within one wall of an equal size or of different sizes within one wall, and by a supporting plate being loosely arranged within the cage or by a supporting plate which may be attached to the cage from outside.

BRIEF DESCRIPTION OF THE DRAWING

On the basis of drawings the invention should be described into more detail with an exemplified embodiment.

The drawings illustrate

DETAILED DESCRIPTION OF PREFERRED EMBODIMENTS

Figure 1:
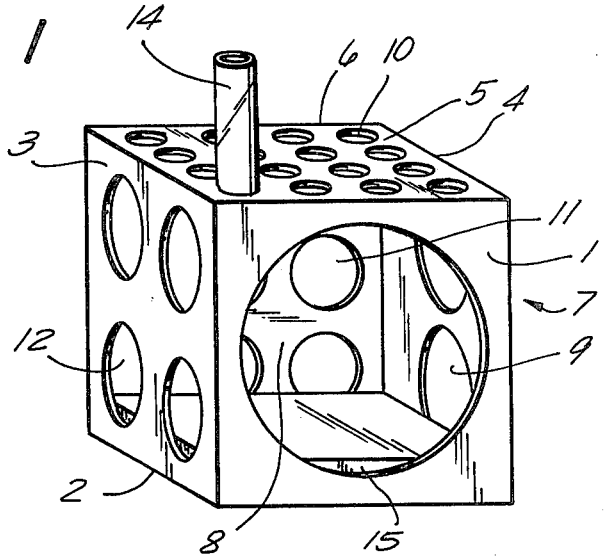
FIG. 1 the reducing socket in cube-shape with inserted supporting plate

The walls 1 to 6 are joined together by welding seams to form a cube-shaped cage 7, which forms the reducing socket. In the individual walls, the openings 8 to 13 are situated, which correspond to the diameters of the test vessels to be accommodated 14. In the cage 7, the supporting plate 15 being freely movable is inserted, which consists of an elastic, but shock resistant material and rests against this wall, which is situated opposite to the wall with the openings as used.

If centrifugation with test vessels 14 should be carried out, the cage 7 (FIG. 1) with the openings corresponding to the test vessel diameter directed above, is inserted into the receptacle carrier (not illustrated here). Herewith the supporting plate falls to the lower wall 2 and covers the openings 9 contained in it, ensuring that the test vessels 14 inserted in the openings 12 of the wall 5 having a smaller size than the openings 9 may not slip through these. The supporting plate 15 is dimensioned in a manner allowing, if the cage is rotated, the plate to fall without particular measures onto the walls 1 to 6 if this is directed underneath.

Figure 2:
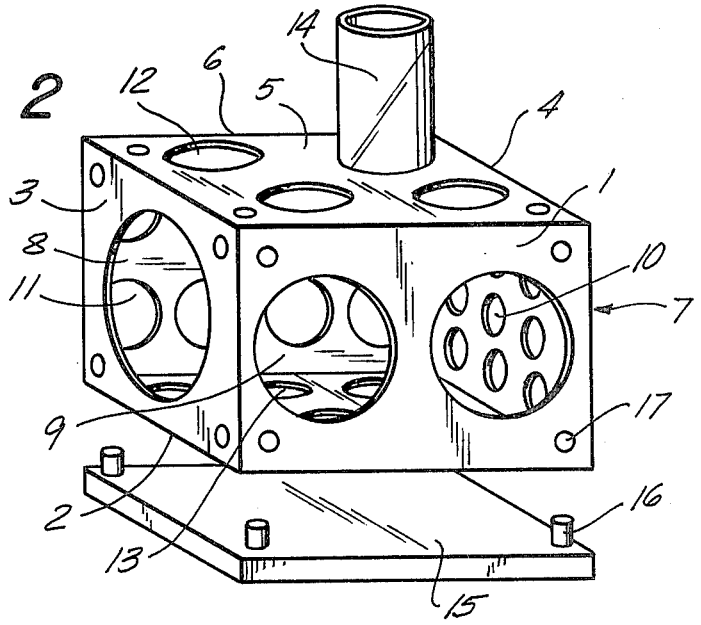
FIG. 2 the reducing socket in parallelepiped-shape with attached supporting plate.

In another version (FIG. 2) the cage is shaped like a parallelepiped. The supporting plate which is adjusted to the parallelepiped-shaped walls, is provided with pivots 16, which are pressed into the burrholes 17 being drilled into the walls, ensuring that the openings of the walls being directed underneath are covered from outside.

We claim:

1. A reducing socket for test tubes adapted to be disposed in receptacle carriers of a laboratory centrifuge, comprising a rectangular cage formed of six rectangular side walls firmly jointed together, each side wall having means defining at least one test tube receiving opening and a plurality of peripherally located, equally sized burr holes, the test tube openings in each side wall being of a different diameter than the test tube openings in each of the other five walls and the burr holes of each side wall having like diameters, so that the test tubes having different diameters can be situated in and supported by the appropriate openings in the cage, and a support plate to be disposed under the rectangular cage for supporting some test tubes disposed in said openings, said support plate having a plurality of projections extending unpwardly therefrom, said projections corresponding to the burr holes of each side wall, so that when the cage is disposed on the support plate, the projections engage the burr holes to thereby immovably connect together the cage with the support plate.

2. A reducing socket for test tubes adapted to be disposed in receptacle carriers of a laboratory centrifuge, comprising a cubic cage formed of six square side walls firmly joined together, each side wall having at least one opening therein, the diameter of the opening in one side wall being different in size from other openings in other side walls so that the test tubes having different diameters can be situated in and supported by the appropriate openings in the cage, and a support plate situated inside the cage, freely movable therein so that the support plate is always located on the bottom of the cage to support thereon each said test tube disposed in each said opening.

* * * * *